US010428755B2

(12) United States Patent
Yanoto

(10) Patent No.: US 10,428,755 B2
(45) Date of Patent: Oct. 1, 2019

(54) CONTROL DEVICE FOR INTERNAL COMBUSTION ENGINE

(71) Applicant: DENSO CORPORATION, Kariya, Aichi-pref. (JP)

(72) Inventor: Keisuke Yanoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 189 days.

(21) Appl. No.: 15/514,834

(22) PCT Filed: Sep. 28, 2015

(86) PCT No.: PCT/JP2015/004906
§ 371 (c)(1),
(2) Date: Mar. 28, 2017

(87) PCT Pub. No.: WO2016/051755
PCT Pub. Date: Apr. 7, 2016

(65) Prior Publication Data

US 2017/0226951 A1 Aug. 10, 2017

(30) Foreign Application Priority Data

Oct. 3, 2014 (JP) ..... 2014-204472

(51) Int. Cl.
*F02D 41/24* (2006.01)
*F02D 41/20* (2006.01)
(Continued)

(52) U.S. Cl.
CPC ..... *F02D 41/2467* (2013.01); *F02D 41/20* (2013.01); *F02M 51/00* (2013.01);
(Continued)

(58) Field of Classification Search
CPC ..... F02D 41/2467; F02D 41/20; F02D 2041/2058; F02D 51/00; F02D 51/061;
(Continued)

(56) References Cited

U.S. PATENT DOCUMENTS 7,089,916 B2 * 8/2006 Abo ..... F02B 23/104 123/299
7,474,035 B2 * 1/2009 Fukagawa ..... F02D 41/2096 123/490

(Continued)

*Primary Examiner* — Mahmoud Gimie
*Assistant Examiner* — Joshua Campbell
(74) *Attorney, Agent, or Firm* — Nixon & Vanderhye P.C.

(57) ABSTRACT

An ECU calculates peak-current arrival time (time elapsed before a detected current arrives at a target peak current), and calculates predetermined-current arrival difference time (time elapsed before the detected current becomes lower than a predetermined current after exceeding the predetermined current). The ECU uses a beforehand stored relationship between the predetermined-current arrival difference time and defined peak-current arrival time to calculate the defined peak-current arrival time corresponding to the latest predetermined-current arrival difference time. The ECU uses such defined peak-current arrival time to compare the latest peak-current arrival time with the defined peak-current arrival time (for example, calculates a difference between the peak-current arrival time and the defined peak-current arrival time), and thus determines a shift in detected current of a current detection circuit.

12 Claims, 10 Drawing Sheets

(51) Int. Cl.
*F02M 51/00* (2006.01)
*F02M 51/06* (2006.01)
*F02M 63/00* (2006.01)

(52) U.S. Cl.
CPC ..... *F02M 51/061* (2013.01); *F02D 2041/202* (2013.01); *F02D 2041/2003* (2013.01); *F02D 2041/2055* (2013.01); *F02D 2041/2058* (2013.01); *F02M 63/0007* (2013.01); *F02M 63/0017* (2013.01)

(58) Field of Classification Search
CPC ..... F02D 2041/2003; F02D 2041/2055; F02D 2041/202; F02M 63/0007; F02M 63/0017
USPC ..... 123/490
See application file for complete search history.

(56) References Cited

U.S. PATENT DOCUMENTS

| | | | | |
|---|---|---|---|---|
| 8,976,893 | B2 * | 3/2015 | Bai | H03F 1/3247 375/296 |
| 2002/0083916 | A1 * | 7/2002 | Maurer | F02M 35/10013 123/198 E |
| 2014/0318498 | A1 * | 10/2014 | Rumpsa | F02D 41/3005 123/478 |
| 2015/0144109 | A1 * | 5/2015 | Mukaihara | F02D 41/2467 123/490 |

* cited by examiner

CONTROL DEVICE FOR INTERNAL COMBUSTION ENGINE

CROSS REFERENCE TO RELATED APPLICATION

This application is the U.S. national phase of International Application No. PCT/JP2015/004906 filed on Sep. 28, 2015 which designated the U.S. and claims priority to Japanese Patent Application No. 2014-204472 filed on Oct. 3, 2014, the disclosure of each of which are incorporated herein by reference.

TECHNICAL FIELD

The present disclosure includes an invention that relates to a control device for an internal combustion engine, which controls a drive current of an electromagnetically-driven fuel injector.

BACKGROUND ART

An electromagnetically-driven fuel injector in general drives a needle to be opened by electromagnetic force generated when a drive coil is energized. At this time, since a valve-opening characteristic of the fuel injector is varied depending on a drive current profile (drive current waveform) of the fuel injector, a valve-opening speed of the fuel injector is greatly affected by a variation in a drive current profile, particularly a variation in a peak current value (a peak value of the drive current), and thus an injection amount tends to further vary with a smaller injection amount of the fuel injector.

In an exemplary case as described in Patent Literature 1, a current detection section that detects a drive current of a fuel injector is provided, and a drive current of the fuel injector is controlled to have a target drive current profile based on the drive current (detected current) detected by the current detection section. In Patent Literature 1, a variation in the drive current due to a machine-difference variation in the current detection section or the like is beforehand measured for each control device, and a control target value (a target value of a drive current or drive time) of the fuel injector is corrected based on the variation in the drive current (current difference value).

For example, the detected current of the current detection section may shift due to aging variation or the like. If the detected current shifts, control accuracy of the drive current of the fuel injector is reduced. Hence, if the detected current of the current detection section shifts, such a shift in the detected current is preferably early detected. However, the technique of Patent Literature 1 cannot determine the shift in the detected current of the current detection section (cannot determine whether or not the detected current is correct). Hence, the technique cannot early detect shift in the detected current if the detected current shifts.

PRIOR ART LITERATURES

Patent Literature

Patent Literature 1: JP 2014-5740 A

SUMMARY OF INVENTION

An object of the present disclosure is to provide a control device for an internal combustion engine, which can determine a shift in a detected current of a current detection section that detects a drive current of a fuel injector, and can early detect a shift in a detected current if the detected current shifts.

According to an embodiment of the present disclosure, a control device for an internal combustion engine includes an electromagnetically-driven fuel injector, a current detection section that detects a drive current of the fuel injector, and a current control section that applies a predetermined voltage to the fuel injector until a drive current (hereinafter, referred to as "detected current"), the drive current being detected by the current detection section when the fuel injector is driven to open a valve, arrives at a predetermined target peak current. The control device for the internal combustion engine further includes an arrival time calculation section that calculates a peak-current arrival time that is time elapsed before the detected current arrives at the target peak current from a predetermined timing; a difference time calculation section that calculates a predetermined-current arrival difference time that is time elapsed before the detected current becomes lower than a predetermined current, which is lower than the target peak current, after exceeding the predetermined current; a storage section that beforehand stores a relationship between the predetermined-current arrival difference time and defined peak-current arrival time that is peak-current arrival time when the detected current is correct; a defined arrival-time calculation section that uses the relationship between the predetermined-current arrival difference time and the defined peak-current arrival time to calculate the defined peak-current arrival time corresponding to the predetermined-current arrival difference time calculated by the difference time calculation section; and a determination section that compares the peak-current arrival time calculated by the arrival time calculation section with the defined peak-current arrival time calculated by the defined arrival-time calculation section to determine shift in the detected current.

If the detected current of the current detection section shifts, the peak-current arrival time (time elapsed before the detected current arrives at the target peak current) is varied; hence, a shift in the detected current can be determined through comparison between the peak-current arrival time and the defined peak-current arrival time (peak-current arrival time when the detected current is correct).

However, if a slope of an actual current (actual drive current) is varied due to a variation in a load resistance caused by a temperature variation, the defined peak-current arrival time is also varied; hence, the defined peak-current arrival time corresponding to a slope of the latest actual current must be used in order to accurately determine shift in the detected current.

In the present disclosure, the predetermined-current arrival difference time (time elapsed before the detected current becomes lower than the predetermined current after exceeding the predetermined current) is calculated as information of the slope of the latest actual current, and the defined peak-current arrival time corresponding to the latest predetermined-current arrival difference time is calculated using the beforehand stored relationship between the predetermined-current arrival difference time and the defined peak-current arrival time. This makes it possible to calculate the defined peak-current arrival time corresponding to the slope of the latest actual current.

The defined peak-current arrival time calculated in this way is used to compare the latest peak-current arrival time with the defined peak-current arrival time (for example, calculate a difference or a ratio between the peak-current arrival time and the defined peak-current arrival time), thereby a shift in a detected current can be accurately determined, and if a detected current shifts, such a shift in the detected current can be early detected.

BRIEF DESCRIPTION OF DRAWINGS

The above-described object and other objects, features, and advantages of the present disclosure will be further clarified by the following detailed description with reference to the accompanying drawings.

DESCRIPTION OF EMBODIMENT

One embodiment embodying a mode for carrying out the present disclosure is now described.

Figure 1:
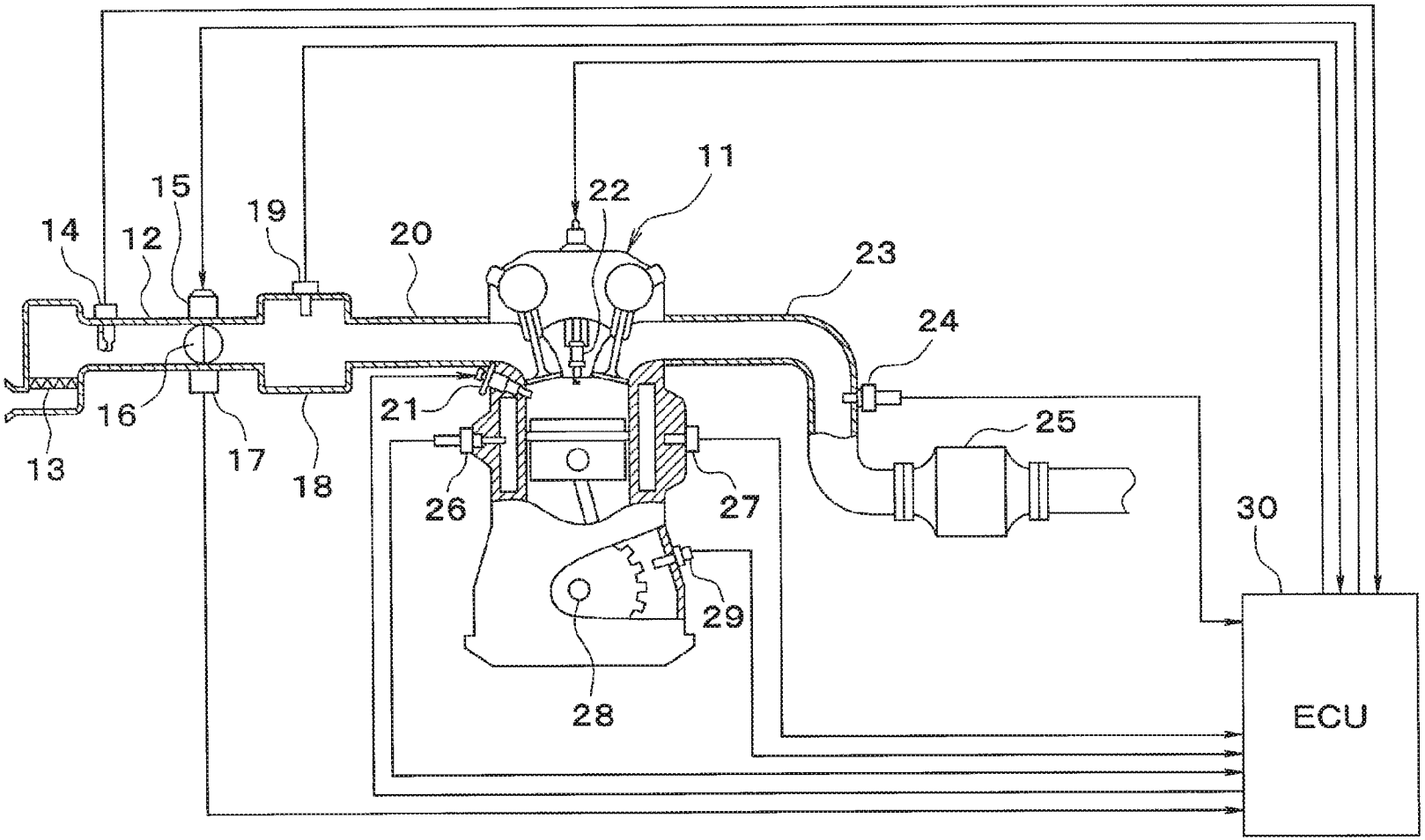
FIG. 1 is a schematic illustration of a configuration of an engine control system of one embodiment of the present disclosure.

A schematic configuration of an engine control system is now described with reference to FIG. 1.

An air cleaner 13 is provided in a most upstream portion of an intake pipe 12 of an in-cylinder injection engine 11 that is an in-cylinder injection internal combustion engine, and an airflow meter 14 that detects intake air mass is provided on a downstream side of the air cleaner 13. A throttle valve 16 of which the opening is regulated by a motor 15, and a throttle opening sensor 17, which detects the opening (throttle opening) of the throttle valve 16, are provided on a downstream side of the airflow meter 14.

Furthermore, a surge tank 18 is provided on a downstream side of the throttle valve 16, and an intake pipe pressure sensor 19 that detects intake pipe pressure is provided in the surge tank 18. The surge tank 18 is provided with an intake manifold 20 that introduces air into each cylinder of the engine 11, and a fuel injector 21 that directly injects fuel into each cylinder is mounted in the cylinder of the engine 11. The fuel injector 21 is an electromagnetically-driven fuel injector that moves an undepicted needle in a valve-opening direction by electromagnetic force generated when an undepicted drive coil is energized. An ignition plug 22 is mounted in the cylinder head of the engine 11 for each cylinder, and an air-fuel mixture in the cylinder is ignited by spark discharge of the ignition plug 22 in the cylinder.

On the other hand, an exhaust gas sensor 24 (air-fuel ratio sensor, oxygen sensor) that detects an air-fuel ratio or rich/lean of exhaust gas is provided in an exhaust pipe 23 of the engine 11, and a catalyst 25 such as a three-way catalyst, which cleans up the exhaust gas, is provided on a downstream side of the exhaust gas sensor 24.

A cooling-water temperature sensor 26 that detects cooling water temperature and a knock sensor 27 that detects knocking are mounted in a cylinder block of the engine 11. A crank angle sensor 29, which outputs a pulse signal every time a crank shaft 28 rotates by a predetermined crank angle, is mounted on an outer circumferential side of the crank shaft 28, and a crank angle and an engine speed are detected based on an output signal of the crank angle sensor 29.

Outputs of such sensors are received by an electronic control unit (ECU) 30. The ECU 30 mainly includes a microcomputer, and executes various engine control programs stored in a built-in ROM (storage medium), and thus controls a fuel injection amount, an ignition timing, a throttle opening (intake air flow), and the like depending on an engine operation state.

Figure 2:
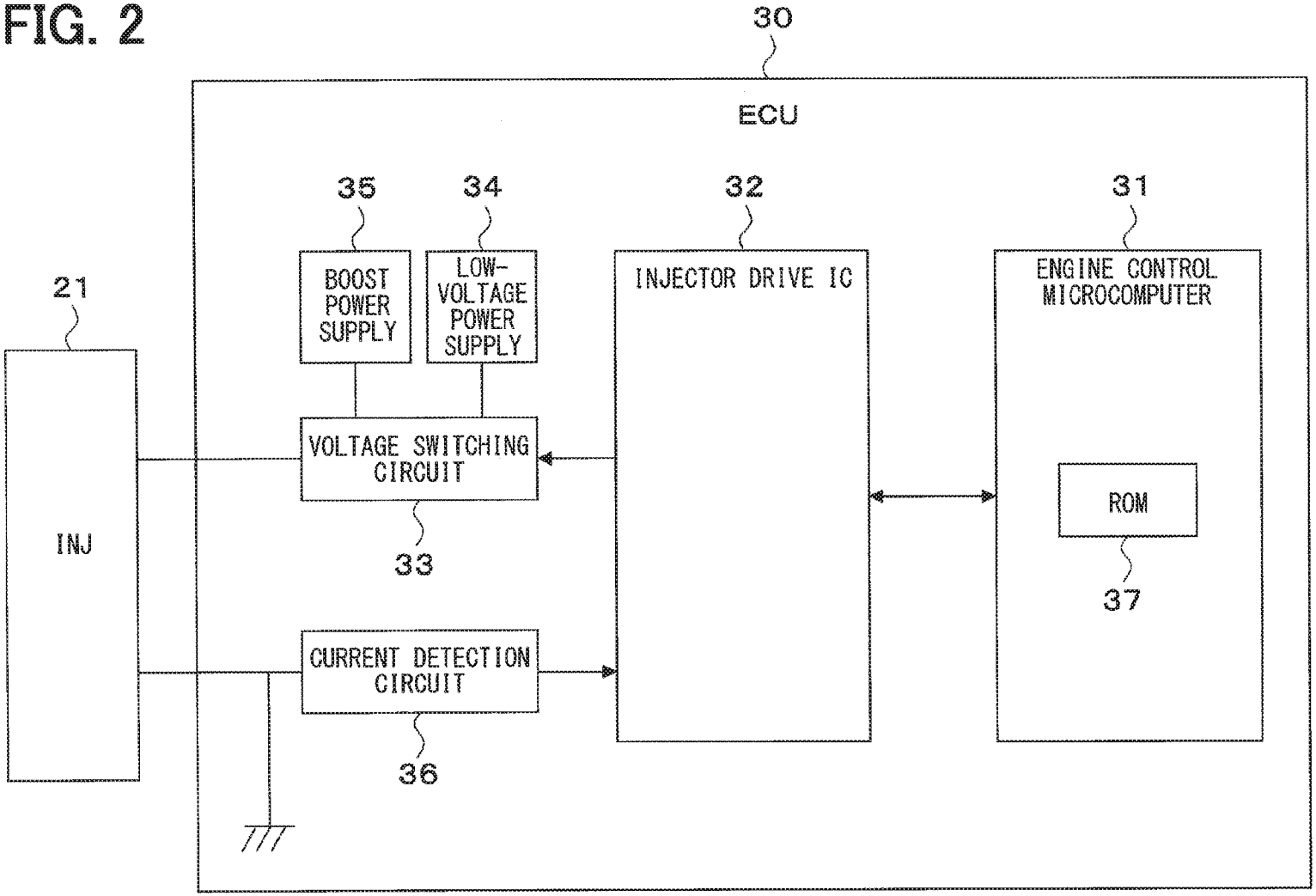
FIG. 2 is a block diagram illustrating a configuration of ECU.

As illustrated in FIG. 2, the ECU 30 includes an engine control microcomputer 31 (a microcomputer for controlling the engine 11), an injector drive IC 32 (drive IC for the fuel injector 21), and the like. The ECU 30 calculates a required injection amount depending on the engine operation state (for example, engine speed or engine load) by the engine control microcomputer 31, calculates an injection pulse width Ti (injection time) in correspondence to the required injection amount, and drives the fuel injector 21 to open a valve with the injection pulse width Ti corresponding to the required injection amount by the injector drive IC 32 to inject a certain amount of fuel corresponding to the required injection amount. At this time, the ECU 30 switches a drive voltage (voltage applied to the drive coil) of the fuel injector 21 between a low voltage supplied from a low-voltage power supply 34 and a high voltage (a voltage boosted for valve opening) supplied from a boost power supply 35, and detects a drive current (current applied to the drive coil) of the fuel injector 21 by a current detection circuit 36 (current detection section).

Figure 3:
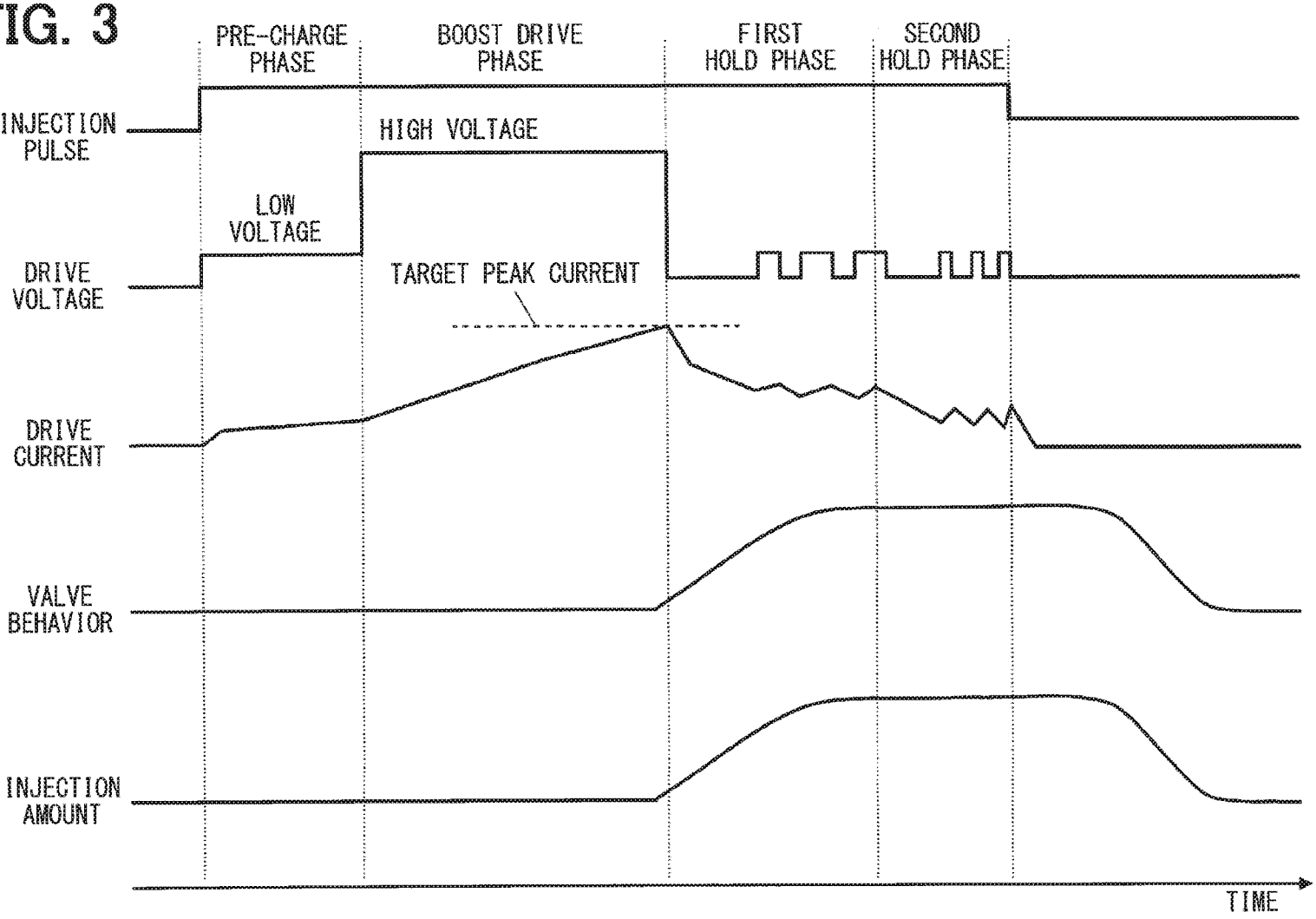
FIG. 3 is a time chart for explaining current control for a fuel injector.

The ECU 30 (at least one of the engine control microcomputer 31 and the injector drive IC 32) serves as a current control section that controls a drive current of the fuel injector 21 while driving the fuel injector 21 to open a valve. Specifically, as illustrated in FIG. 3, a control phase of the drive current of the fuel injector 21 is sequentially changed, after an injection pulse is turned on, in the following order: a pre-charge phase, a boost drive phase, a first hold phase, and a second hold phase.

First, in the pre-charge phase, a low voltage is applied to the drive coil of the fuel injector 21 to gradually increase the drive current.

Subsequently, in the boost drive phase, a high voltage (voltage boosted for valve opening) is applied to the drive coil of the fuel injector 21 to rapidly increase the drive current to a predetermined target peak current so that a needle of the fuel injector 21 is opened. When a drive current (hereinafter, referred to as "detected current") detected by the current detection section 36 arrives at the target peak current, application of the high voltage is stopped.

Subsequently, in the first hold phase, the low voltage is intermittently applied to the drive coil of the fuel injector 21 to maintain the drive current around a pickup current lower than the target peak current, thereby the needle of the fuel injector 21 is moved to a valve opening position.

Subsequently, in the second hold phase, the low voltage is intermittently applied to the drive coil of the fuel injector 21 to maintain the drive current around a hold current lower than the pickup current, thereby the needle of the fuel injector 21 is maintained at the valve opening position.

Subsequently, at a point where the injection pulse is turned off, a current application to the drive coil of the fuel injector 21 is stopped so that the needle of the fuel injector 21 is closed.

The detected current of the current detection circuit 36 may shift due to some influence (for example, aging variation). If the detected current shifts, a control accuracy of the drive current of the fuel injector 21 is deteriorated.

Figure 4A:
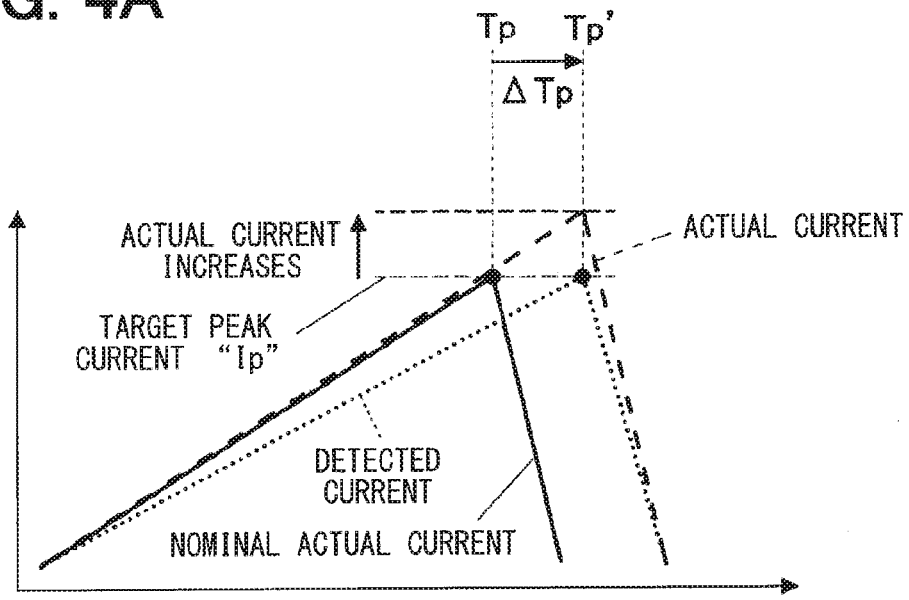
FIG. 4A is a time chart illustrating a behavior of each current when a detected current shifts.
Figure 4B:
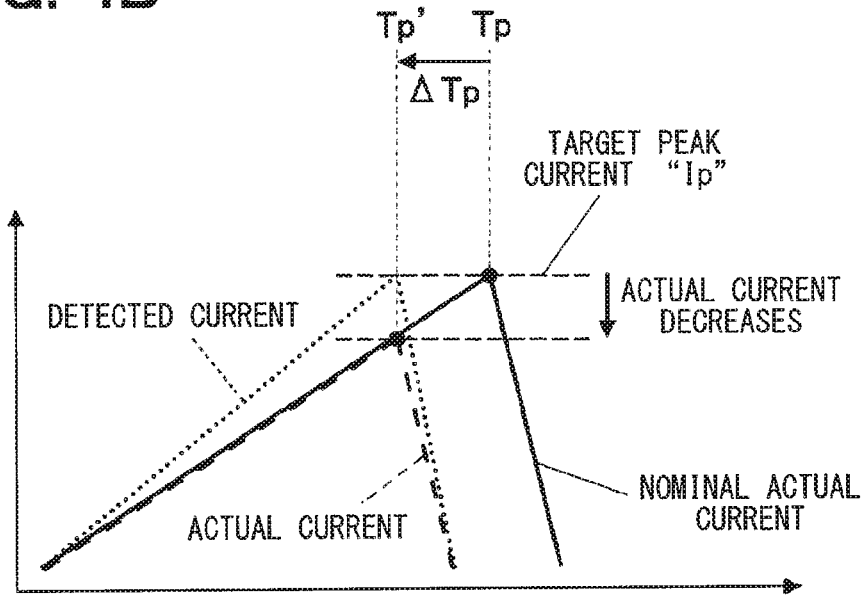
FIG. 4B is a time chart illustrating a behavior of each current when a detected current shifts.

For example, as illustrated in FIG. 4A, when the detected current shifts to a lower side with respect to an actual current (actual drive current), the actual current increases until the detected current lower than the actual current arrives at the target peak current; hence, an actual peak current (a peak value of the actual current) exceeds the target peak current. On the other hand, as illustrated in FIG. 4B, when the detected current shifts to a higher side with respect to the actual current, the actual current increases until the detected current higher than the actual current arrives at the target peak current; hence, the actual peak current becomes lower than the target peak current.

Hence, if the detected current of the current detection circuit 36 shifts, such a shift in the detected current is preferably early detected.

In this embodiment, therefore, the ECU 30 (at least one of the engine control microcomputer 31 and the injector drive IC 32) executes the detected-current shift determination routine of FIG. 9 as described later, and thus determines the shift in the detected current as follows.

The ECU 30 calculates a peak-current arrival time Tp' that is time elapsed before the detected current arrives at the target peak current Ip from a predetermined timing, and a predetermined-current arrival difference time ΔTth that is time elapsed before the detected current becomes lower than a predetermined current Ith lower than the target peak current Ip after exceeding the predetermined current Ith. A ROM 37 (storage section) of the ECU 30 is allowed to beforehand store a relationship between the predetermined-current arrival difference time ΔTth and the defined peak-current arrival time Tp that is peak-current arrival time when the detected current is correct (for example, a map defining the relationship between the predetermined-current arrival difference time ΔTth and the defined peak-current arrival time Tp). The relationship between the predetermined-current arrival difference time ΔTth and the defined peak-current arrival time Tp is used to calculate the defined peak-current arrival time Tp corresponding to the currently calculated predetermined-current arrival difference time ΔTth, and the currently calculated peak-current arrival time Tp' is compared with the currently calculated defined peak-current arrival time Tp to determine the shift in the detected current.

If the detected current of the current detection circuit 36 shifts, the peak-current arrival time Tp' (time elapsed before the detected current arrives at the target peak current Ip) is varied.

For example, as illustrated in FIG. 4A, when the detected current shifts to a lower side with respect to the actual current, the peak-current arrival time Tp' becomes longer than the defined peak-current arrival time Tp (peak-current arrival time when the detected current is correct) (Tp'>Tp). On the other hand, as illustrated in FIG. 4B, when the detected current shifts to a higher side with respect to the actual current, the peak-current arrival time Tp' becomes shorter than the defined peak-current arrival time Tp (Tp'<Tp).

Hence, the shift in the detected current can be determined through comparison between the peak-current arrival time Tp' and the defined peak-current arrival time Tp (for example, calculation of a difference ΔTp between the peak-current arrival time Tp' and the defined peak-current arrival time Tp).

However, if a slope of the actual current is varied due to a variation in a load resistance caused by temperature variation, the defined peak-current arrival time Tp is also varied.

Figure 5A:
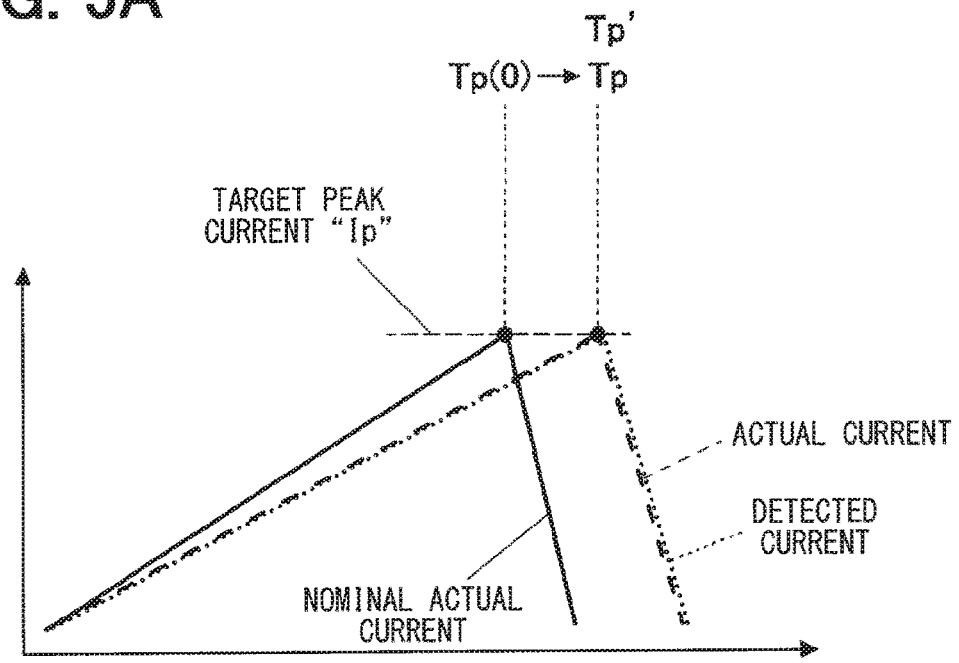
FIG. 5A is a time chart illustrating a behavior of each current when a slope of an actual current shifts.
Figure 5B:
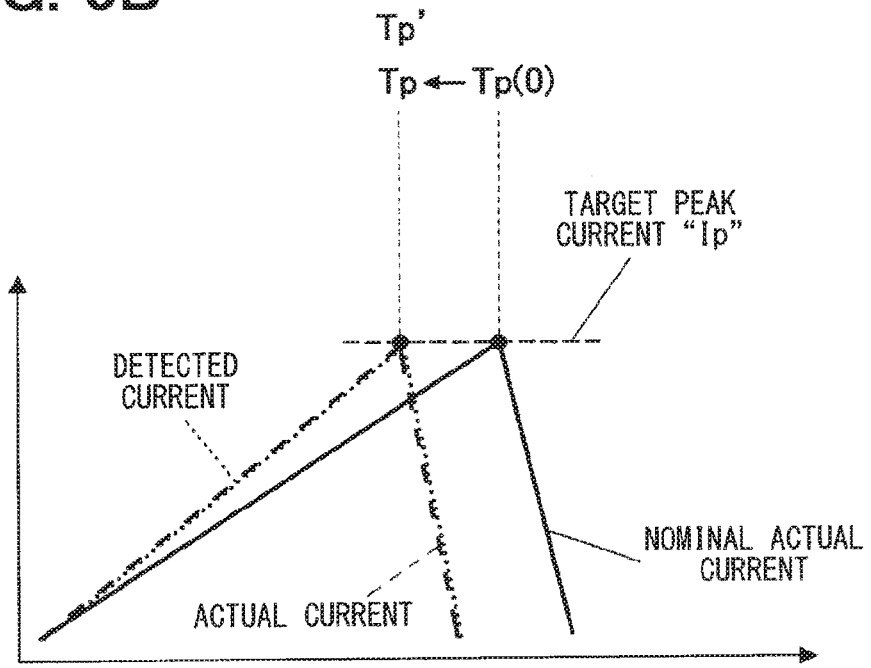
FIG. 5B is a time chart illustrating a behavior of each current when a slope of an actual current shifts.
Figure 6A:
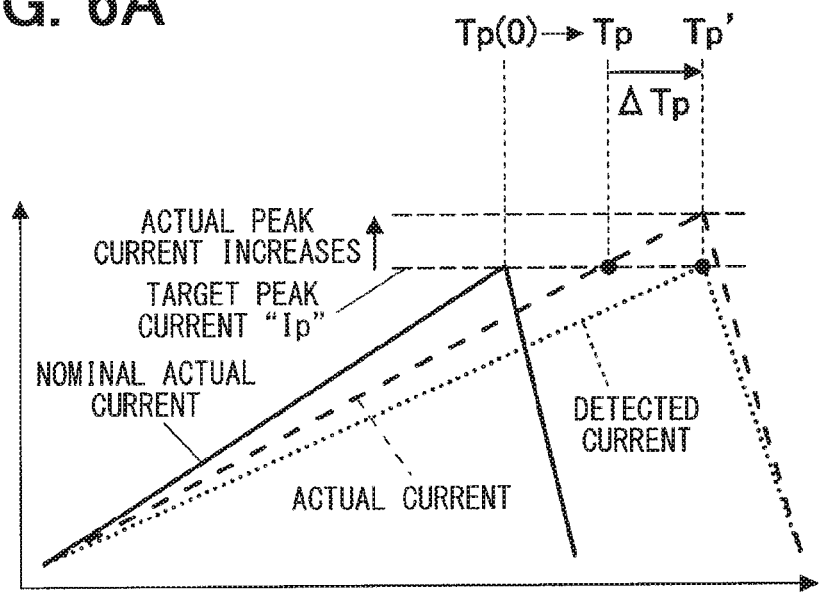
FIG. 6A is a time chart illustrating a behavior of each current when a slope of an actual current and a detected current shift together.
Figure 6B:
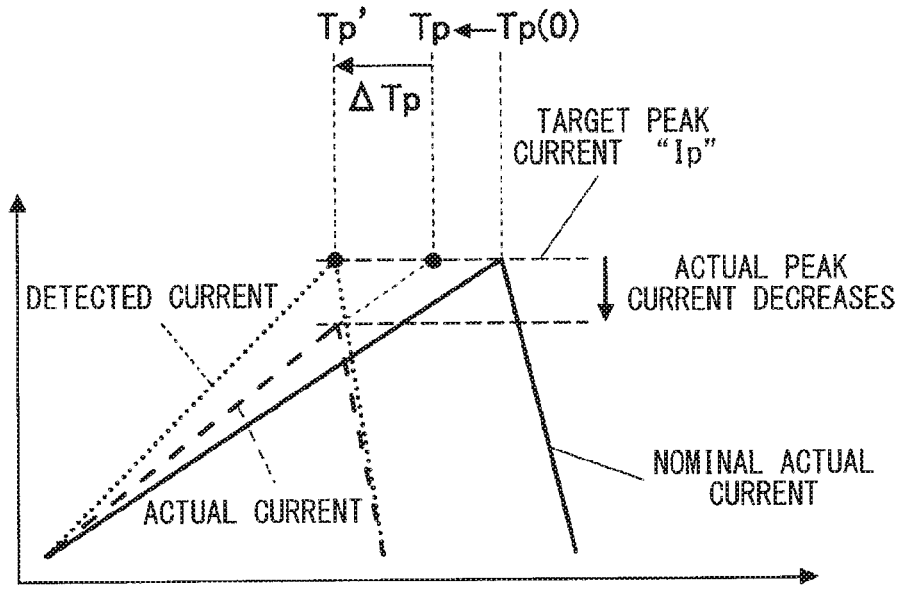
FIG. 6B is a time chart illustrating a behavior of each current when a slope of an actual current and a detected current shift together.

For example, as illustrated in FIGS. 5A and 6A, when the slope of the actual current shifts to a smaller side (the slope is reduced) with respect to a slope of a nominal actual current (an actual current in a standard state), the defined peak-current arrival time Tp becomes longer than a nominal value Tp(0) (peak current arrival time of the nominal actual current). On the other hand, as illustrated in FIGS. 5B and 6B, when the slope of the actual current shifts to a larger side (the slope is increased) with respect to the slope of the nominal actual current, the defined peak-current arrival time Tp becomes shorter than the nominal value Tp(0).

It is therefore necessary to use the defined peak-current arrival time Tp corresponding to the slope of the latest actual current in order to accurately determine the shift in the detected current.

In this embodiment, the predetermined-current arrival difference time ΔTth (time elapsed before the detected current becomes lower than the predetermined current Ith after exceeding the predetermined current Ith) as information of the slope of the latest actual current.

Figure 7A:
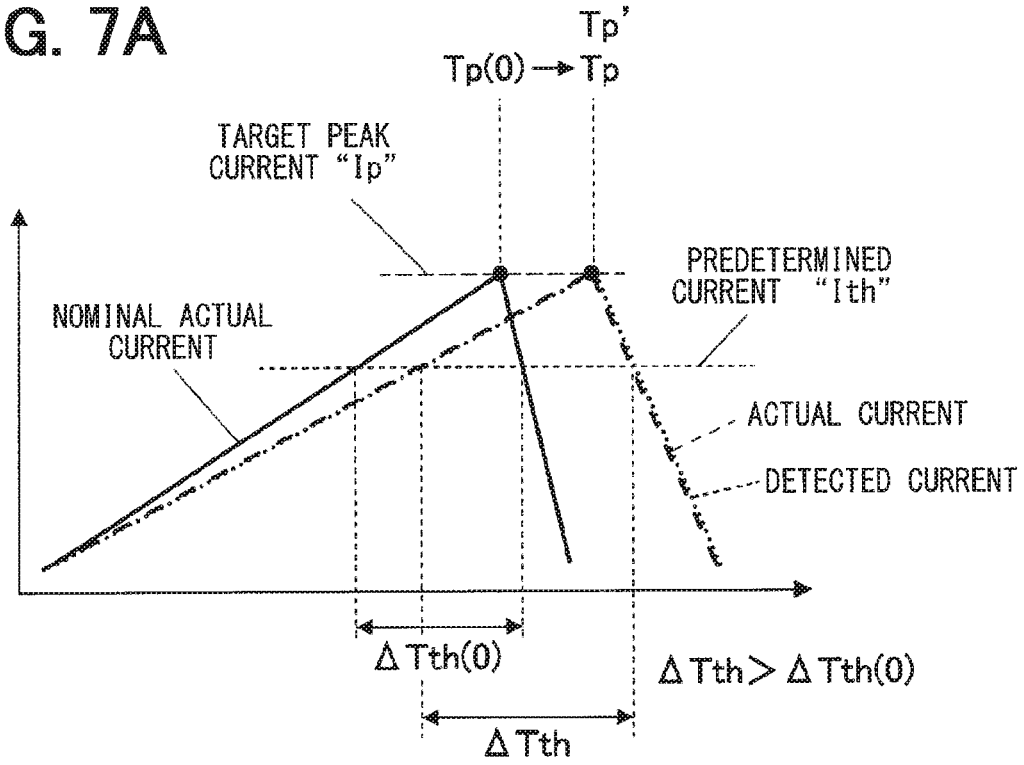
FIG. 7A is a time chart for explaining predetermined-current arrival difference time ΔTth when a slope of an actual current shifts.
Figure 7B:
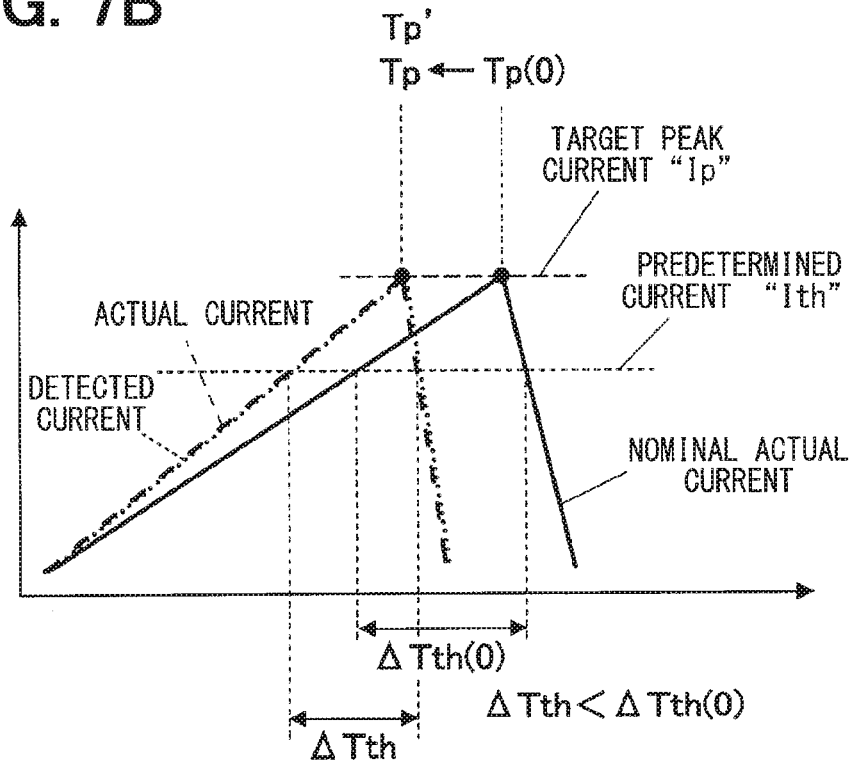
FIG. 7B is a time chart for explaining predetermined-current arrival difference time ΔTth when a slope of an actual current shifts.

For example, as illustrated in FIG. 7A, when the slope of the actual current shifts to a smaller side (the slope becomes gentler) with respect to the slope of the nominal actual current, the predetermined-current arrival difference time ΔTth becomes longer than a nominal value ΔTth(0) (predetermined-current arrival difference time of the nominal actual current). On the other hand, as illustrated in FIG. 7B, when the slope of the actual current shifts to a larger side (the slope becomes larger) with respect to the slope of the nominal actual current, the predetermined-current arrival difference time ΔTth becomes shorter than the nominal value ΔTth(0).

Figure 8A:
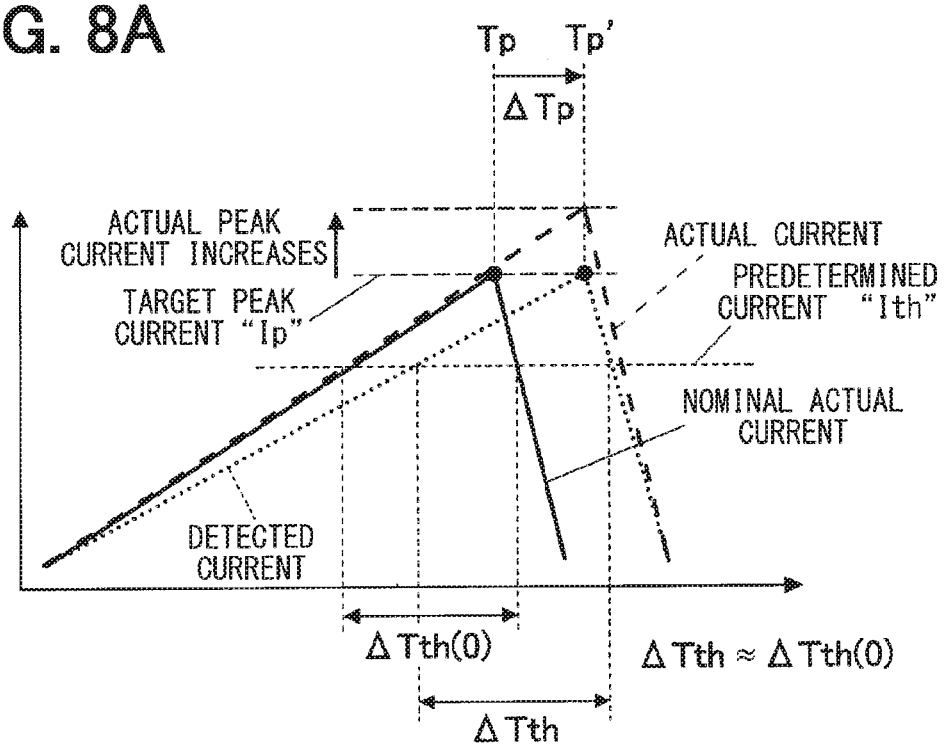
FIG. 8A is a time chart for explaining predetermined-current arrival difference time ΔTth when a detected current shifts.
Figure 8B:
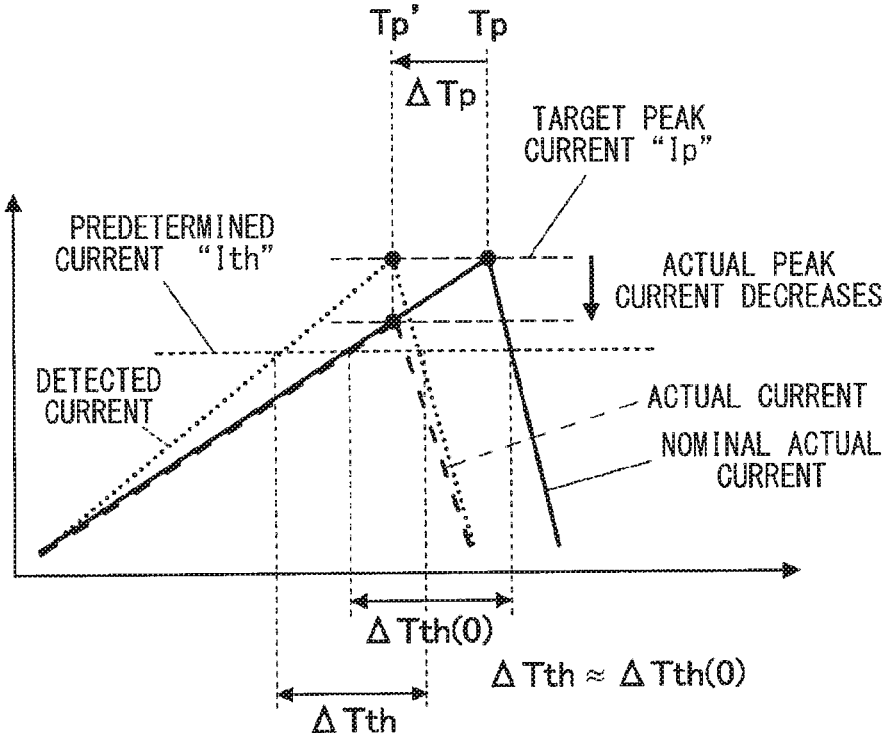
FIG. 8B is a time chart for explaining predetermined-current arrival difference time ΔTth when a detected current shifts.

As illustrated in FIGS. 8A and 8B, when the detected current shifts to a lower or higher side with respect to the actual current while the slope of the actual current is substantially equal to the slope of the nominal actual current, the predetermined-current arrival difference time ΔTth is substantially not varied (the predetermined-current arrival difference time ΔTth is roughly the same as the nominal value ΔTth(0)). This is because shift in the detected current occurs due to a variation in the current detection circuit 36 and causes gain deviation on a current value; hence, the predetermined-current arrival difference time ΔTth (time elapsed before the detected current becomes lower than the predetermined current Ith after exceeding the predetermined current Ith) is calculated with the same predetermined current Ith as in this embodiment, thereby influence of the gain deviation can be reduced. For example, when the predetermined-current arrival difference time ΔTth (time elapsed before the detected current becomes lower than a predetermined current Ith2 after exceeding a predetermined current Ith1) is calculated with two different predetermined currents Ith1 and Ith2, absolute values of shift amounts of the detected current are different between a low current side and a high current side, and thus when shift in the detected current occurs, the predetermined-current arrival difference time ΔTth is also varied.

Hence, the predetermined-current arrival difference time ΔTth (time elapsed before the detected current becomes lower than the predetermined current Ith after exceeding the predetermined current Ith) calculated with the same predetermined current Ith is information accurately reflecting the slope of the latest actual current.

The beforehand stored relationship between the predetermined-current arrival difference time ΔTth and the defined peak-current arrival time Tp (for example, the map defining the relationship between the predetermined-current arrival difference time ΔTth and the defined peak-current arrival time Tp) is used to calculate the defined peak-current arrival time Tp corresponding to the latest predetermined-current arrival difference time ΔTth. This makes it possible to calculate the defined peak-current arrival time Tp corresponding to the slope of the latest actual current.

The defined peak-current arrival time Tp calculated in this way is used to compare the latest peak-current arrival time Tp' with the defined peak-current arrival time Tp (for example, calculate the difference ΔTp between the peak-current arrival time Tp' and the defined peak-current arrival time Tp), thereby shift in the detected current can be accurately determined.

The slope of the actual current is also varied by a drive voltage Vreg of the fuel injector 21, and thus the predetermined-current arrival difference time ΔTth is varied. In this embodiment, therefore, the drive voltage Vreg of the fuel injector 21 is detected or estimated, and the predetermined-current arrival difference time ΔTth is corrected in correspondence to the drive voltage Vreg (for example, the predetermined-current arrival difference time ΔTth is corrected using the difference-time correction value ΔTth.cr corresponding to the drive voltage Vreg).

Hereinafter, it will be described about processing details of the detected-current shift determination routine of FIG. 9 executed by the ECU 30 (at least one of the engine control microcomputer 31 and the injector drive IC 32) in this embodiment.

Figure 9:
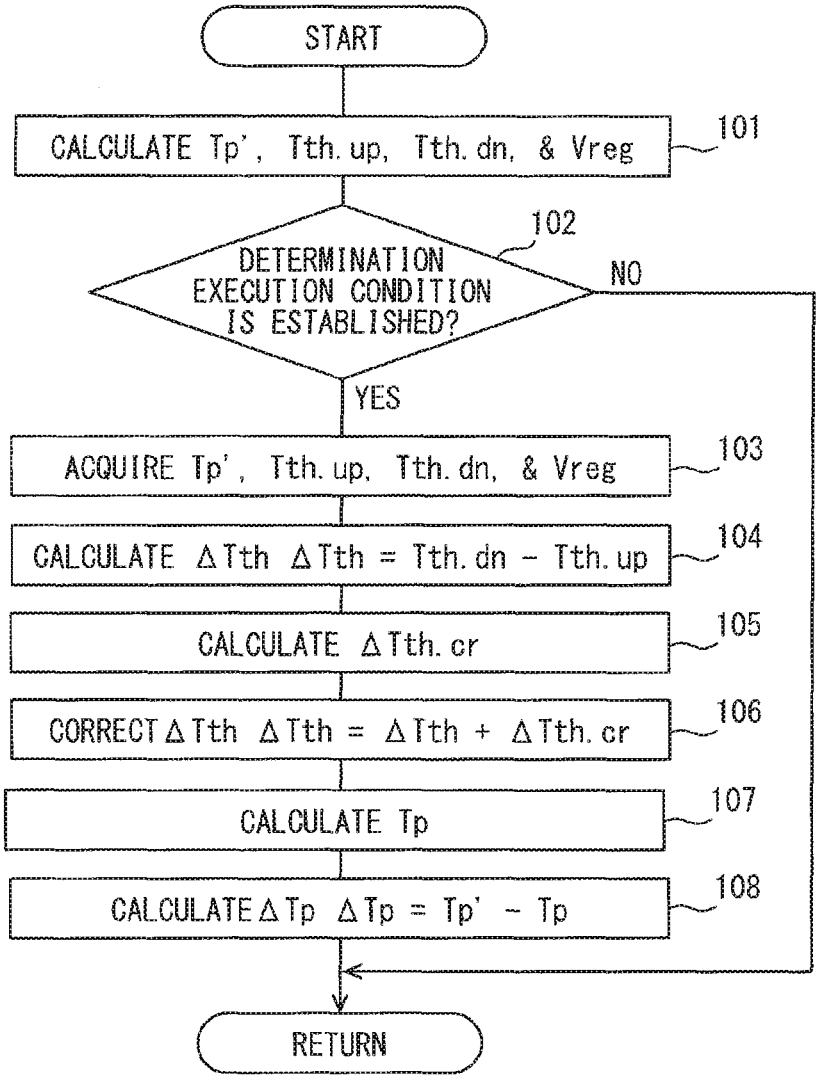
FIG. 9 is a flowchart illustrating a procedure of processing of a detected-current shift determination routine.

The detected-current shift determination routine as illustrated in FIG. 9 is repeatedly executed with a predetermined period during power-on of the ECU 30.

When the routine is started, first, in step 101, time elapsed before the detected current arrives at the target peak current Ip from a timing at which a high-voltage energization pulse is turned on (timing at which a high voltage is applied to the drive coil of the fuel injector 21) is calculated as the peak-current arrival time Tp'. This processing serves as an arrival time calculation section. In addition, time elapsed before the detected current exceeds the predetermined current Ith from the timing at which the high-voltage energization pulse is turned on is calculated as first arrival time Tth.up, and time elapsed before the detected current becomes lower than the predetermined current Ith from the timing at which the high-voltage energization pulse is turned on is calculated as second arrival time Tth.dn. Furthermore, the drive voltage Vreg of the fuel injector 21 is detected or estimated (calculated).

Subsequently, the routine proceeds to step 102, in which whether or not a predetermined determination execution condition is established is determined based on whether or not an engine operation state (engine speed, engine load, cooling water temperature, and the like) is in a steady state (stable state), for example.

If the determination execution condition is determined to be not established in step 102, the routine is finished without execution of processing of step 103 or later.

If the determination execution condition is determined to be established in step 102, the routine proceeds to step 103, in which the peak-current arrival time Tp', the first arrival time Tth.up, and the second arrival time Tth.dn, which are calculated in step 101, are acquired, and the drive voltage Vreg detected or estimated in step 101 is acquired.

Subsequently, the routine proceeds to step 104, in which a difference between the first arrival time Tth.up and the second arrival time Tth.dn is calculated as the predetermined-current arrival difference time ΔTth.

$$\Delta Tth = Tth.dn - Tth.up$$

The processing of step 104 serves as a difference time calculation section.

Figure 10:
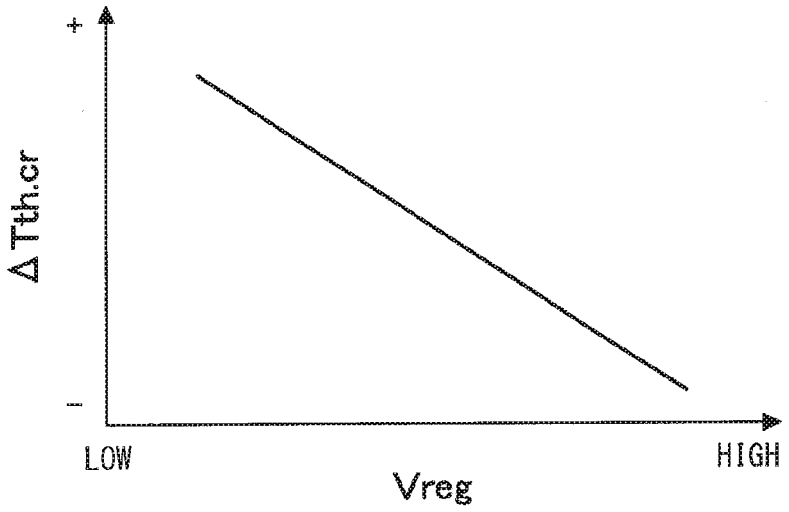
FIG. 10 is a diagram conceptually illustrating an exemplary map of a difference-time correction value ΔTth.cr.

Subsequently, the routine proceeds to step 105, in which the difference-time correction value ΔTth.cr corresponding to the drive voltage Vreg is calculated with reference to a map of the difference-time correction value ΔTth.cr as illustrated in FIG. 10. The map of the difference-time correction value ΔTth.cr is set such that as the drive voltage Vreg is higher, the difference-time correction value ΔTth.cr is smaller so that the predetermined-current arrival difference time ΔTth is smaller (as the drive voltage Vreg is lower, the difference-time correction value ΔTth.cr is larger so that the predetermined-current arrival difference time ΔTth is larger). The map of the difference-time correction value ΔTth.cr is beforehand created based on test data, design data, and the like, and is stored in the ROM 37 of the ECU 30.

Subsequently, the routine proceeds to step 106, in which the difference-time correction value ΔTth.cr is added to the predetermined-current arrival difference time ΔTth to correct the predetermined-current arrival difference time ΔTth.

$$\Delta Tth = \Delta Tth + \Delta Tth.cr$$

The processing of step 105 and the processing of step 106 collectively serve as a correction section.

Figure 11:
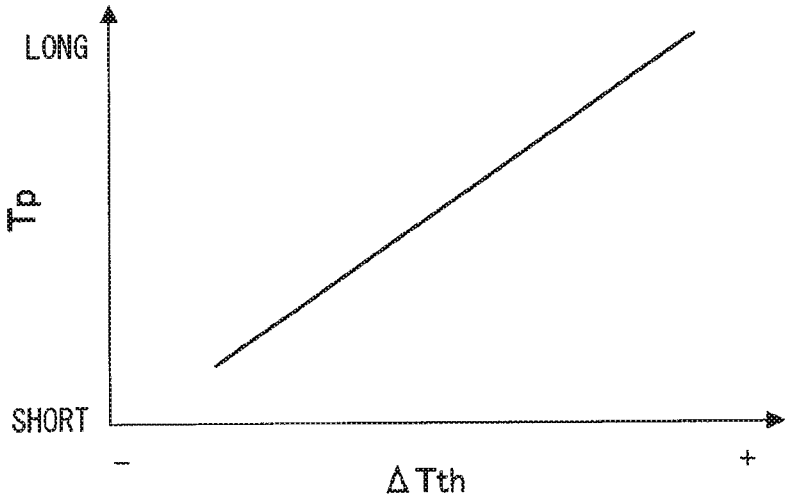
FIG. 11 is a diagram conceptually illustrating an exemplary map of defined peak-current arrival time Tp.

Subsequently, the routine proceeds to step 107, in which the defined peak-current arrival time Tp corresponding to the predetermined-current arrival difference time ΔTth is calculated with reference to a map of the defined peak-current arrival time Tp as illustrated in FIG. 11 (a map defining a relationship between the predetermined-current arrival difference time ΔTth and the defined peak-current arrival time Tp). The map of the defined peak-current arrival time Tp is set such that as the predetermined-current arrival difference time ΔTth is longer, the defined peak-current arrival time Tp is longer (as the predetermined-current arrival difference time ΔTth is shorter, the defined peak-current arrival time Tp is shorter). The map of the defined peak-current arrival time Tp is beforehand created based on test data, design data, and the like, and is stored in the ROM 37 of the ECU 30. The processing of step 107 serves as a defined arrival time calculation section.

Subsequently, the routine proceeds to step 108, in which a difference between the peak-current arrival time Tp' and the defined peak-current arrival time Tp is calculated as peak-current arrival difference time ΔTp.

$$\Delta Tp = Tp' - Tp$$

As described before, when the detected current shifts to a lower side with respect to the actual current, the peak-current arrival time Tp' becomes longer than the defined peak-current arrival time Tp (Tp'>Tp). On the other hand, when the detected current shifts to a higher side with respect to the actual current, the peak-current arrival time Tp' becomes shorter than the defined peak-current arrival time Tp (Tp'<Tp). Hence, the shift in the detected current can be determined through calculation of the peak-current arrival difference time ΔTp (the difference between the peak-current arrival time Tp' and the defined peak-current arrival time Tp). The processing of step 108 serves as a determination section.

In the above-described embodiment, the peak-current arrival time Tp' (time elapsed before the detected current arrives at the target peak current Ip) is calculated, and the predetermined-current arrival difference time ΔTth (time elapsed before the detected current becomes lower than the predetermined current Ith after exceeding the predetermined current Ith) is calculated. In addition, the defined peak-current arrival time Tp corresponding to the latest predetermined-current arrival difference time ΔTth is calculated using the beforehand stored relationship between the predetermined-current arrival difference time ΔTth and the defined peak-current arrival time Tp. This makes it possible to calculate the defined peak-current arrival time Tp corresponding to the slope of the latest actual current. Furthermore, the defined peak-current arrival time Tp calculated in this way is used to compare the latest peak-current arrival time Tp' with the defined peak-current arrival time Tp (for example, calculate the difference ΔTp between the peak-current arrival time Tp' and the defined peak-current arrival time Tp). Consequently, the shift in the detected current can be accurately determined, and if the detected current shifts, such shift in the detected current can be early detected.

In this embodiment, the difference between time elapsed before the detected current exceeds the predetermined current Ith from the timing at which the high-voltage energization pulse is turned on (first arrival time Tth.up) and time elapsed before the detected current becomes lower than the predetermined current Ith from the timing at which the high-voltage energization pulse is turned on (second arrival time Tth.dn) is calculated as the predetermined-current arrival difference time ΔTth. Consequently, the predetermined-current arrival difference time ΔTth (the difference between the first arrival time Tth.up and the second arrival time Tth.dn) can be accurately calculated with reference to the timing at which the high-voltage energization pulse is turned on.

Furthermore, in this embodiment, time elapsed before the detected current arrives at the target peak current Ip after the high-voltage energization pulse is turned on is calculated as the peak-current arrival time Tp'. Consequently, the peak-current arrival time Tp' can be accurately calculated with reference to the timing at which the high-voltage energization pulse is turned on.

In this embodiment, the map of the defined peak-current arrival time Tp (the map defining the relationship between the predetermined-current arrival difference time ΔTth and the defined peak-current arrival time Tp) is set such that as the predetermined-current arrival difference time ΔTth is longer, the defined peak-current arrival time Tp is longer (as the predetermined-current arrival difference time ΔTth is shorter, the defined peak-current arrival time Tp is shorter). Consequently, the relationship between the predetermined-current arrival difference time ΔTth and the defined peak-current arrival time Tp can be appropriately set.

Furthermore, in this embodiment, the predetermined-current arrival difference time ΔTth is corrected in correspondence to the drive voltage Vreg of the fuel injector 21. The predetermined-current arrival difference time ΔTth is thus corrected in correspondence to a variation in the predetermined-current arrival difference time ΔTth based on the slope of the actual current varied depending on the drive voltage Vreg, so that the predetermined-current arrival difference time ΔTth in consideration of influence of the drive voltage Vreg can be obtained.

At this time, in this embodiment, the difference-time correction value ΔTth.cr (correction value for predetermined-current arrival difference time ΔTth) is set such that as the drive voltage Vreg is higher, the predetermined-current arrival difference time ΔTth is smaller (as the drive voltage Vreg is lower, the predetermined-current arrival difference time ΔTth is larger). Consequently, the difference-time correction value ΔTth.cr can be set to an appropriate value.

Although the difference ΔTp between the peak-current arrival time Tp' and the defined peak-current arrival time Tp is calculated to compare the peak-current arrival time Tp' with the defined peak-current arrival time Tp in the above-described embodiment, this is not limitative. For example, a ratio of the peak-current arrival time Tp' to the defined peak-current arrival time Tp may be calculated.

Although the difference between the first arrival time Tth.up and the second arrival time Tth.dn is calculated as the predetermined-current arrival difference time ΔTth in the above-described embodiment, this is not limitative. For example, the time elapsed before the detected current becomes lower than the predetermined current Ith after exceeding the predetermined current Ith may be directly calculated (measured).

Although a correction value is added to the predetermined-current arrival difference time ΔTth to correct the predetermined-current arrival difference time ΔTth in the above-described embodiment, this is not limitative. For example, the predetermined-current arrival difference time ΔTth may be multiplied by a correction value (correction coefficient) to correct the predetermined-current arrival difference time ΔTth.

In practical operation, the present disclosure can be applied not only to the system having the in-cylinder injection fuel injector but also to a system having an intake-port injection fuel injector.

Although the present disclosure has been described according to an embodiment, it will be understood that the present disclosure is not limited to such embodiment and relevant structures. The present disclosure includes various modifications and variations within the equivalent scope. In addition, the category or the technical idea of the present disclosure includes various combinations and modes, and further includes other combinations and modes that contain one, not less than one, or not more than one additional element.

The invention claimed is:

1. A control device for an internal combustion engine, having: an electromagnetically-driven fuel injector; a current detection section that detects a drive current of the fuel injector; and a current control section that applies a predetermined voltage to the fuel injector until a detected current, the detected current being detected by the current detection section when the fuel injector is driven to open a valve, arrives at a predetermined target peak current, the control device comprising:

an arrival time calculation section that calculates a peak-current arrival time that is a time elapsed before the detected current arrives at the target peak current from a predetermined timing;

a difference time calculation section that calculates a predetermined-current arrival difference time that is a time elapsed before the detected current becomes lower than a predetermined current, which is lower than the target peak current, after exceeding the predetermined current;

a storage section that stores values of the predetermined-current arrival difference time and values of a defined peak-current arrival time wherein the values of the predetermined-current arrival difference time correspond to the values of the defined peak-current arrival time, respectively;

a defined arrival-time calculation section that uses a relationship between the values of the predetermined-current arrival difference time and the values of the defined peak-current arrival time to calculate one of the values of the defined peak-current arrival time corresponding to one of the values of the predetermined-current arrival difference time calculated by the difference time calculation section; and a determination section that compares the peak-current arrival time calculated by the arrival time calculation section with the defined peak-current arrival time calculated by the defined arrival-time calculation section to determine a shift in the detected current with respect to an actual current.

2. The control device for the internal combustion engine according to claim 1, wherein the difference time calculation section calculates, as one of the values of the predetermined-current arrival difference time, a difference between a time elapsed before the detected current exceeds the predetermined current after an energization pulse having the predetermined voltage is turned on, and a time elapsed before the detected current becomes lower than the predetermined current after the energization pulse is turned on.

3. The control device for the internal combustion engine according to claim 1, wherein the arrival time calculation section calculates, as the peak-current arrival time, a time elapsed before the detected current arrives at the target peak current after the energization pulse having the predetermined voltage is turned on.

4. The control device for the internal combustion engine according to claim 1, wherein the relationship between the predetermined-current arrival difference time and the defined peak-current arrival time is set such that as the predetermined-current arrival difference time is longer, the defined peak-current arrival time is longer.

5. The control device for the internal combustion engine according to claim 1, further comprising:

a correction section that corrects the predetermined-current arrival difference time in correspondence to a drive voltage of the fuel injector.

6. The control device for the internal combustion engine according to claim 5, wherein the correction section sets a correction value for the predetermined-current arrival difference time such that as the drive voltage is higher, the predetermined-current arrival difference time is smaller.

7. A control device for an internal combustion engine, having: an electromagnetically-driven fuel injector; a current detector that detects a drive current of the fuel injector; and a current controller that applies a predetermined voltage to the fuel injector until a detected current, the detected current being detected by the current detector when the fuel injector is driven to open a valve, arrives at a predetermined target peak current, the control device comprising:

a computer for executing code so that the computer is at least configured to perform:

an arrival time calculation that calculates a peak-current arrival time that is a time elapsed before the detected current arrives at the target peak current from a predetermined timing;

a difference time calculation that calculates a predetermined-current arrival difference time that is a time elapsed before the detected current becomes lower than a predetermined current, which is lower than the target peak current, after exceeding the predetermined current; and a storage memory configured to store values of the predetermined-current arrival difference time and values of a defined peak-current arrival time wherein the values of the predetermined-current arrival difference time correspond to the values of the defined peak-current arrival time, respectively;

the computer being further configured to perform:

a defined arrival-time calculation that uses a relationship between the values of the predetermined-current arrival difference time and the values of the defined peak-current arrival time to calculate one of the values of the defined peak-current arrival time corresponding to one of the values of the predetermined-current arrival difference time calculated by the difference time calculation; and a determination that compares the peak-current arrival time calculated by the arrival time calculation with the defined peak-current arrival time calculated by the defined arrival-time calculation to determine a shift in the detected current with respect to an actual current.

8. The control device for the internal combustion engine according to claim 7, wherein the difference time calculation calculates, as one of the values of the predetermined-current arrival difference time, a difference between a time elapsed before the detected current exceeds the predetermined current after an energization pulse having the predetermined voltage is turned on, and a time elapsed before the detected current becomes lower than the predetermined current after the energization pulse is turned on.

9. The control device for the internal combustion engine according to claim 7, wherein the arrival time calculation calculates, as the peak-current arrival time, a time elapsed before the detected current arrives at the target peak current after the energization pulse having the predetermined voltage is turned on.

10. The control device for the internal combustion engine according to claim 7, wherein the relationship between the predetermined-current arrival difference time and the defined peak-current arrival time is set such that as the predetermined-current arrival difference time is longer, the defined peak-current arrival time is longer.

11. The control device for the internal combustion engine according to claim 7, wherein the computer being further configured to perform:

a correction that corrects the predetermined-current arrival difference time in correspondence to a drive voltage of the fuel injector.

12. The control device for the internal combustion engine according to claim 11, wherein the correction sets a correction value for the predetermined-current arrival difference time such that as the drive voltage is higher, the predetermined-current arrival difference time is smaller.

* * * * *